US007255230B1

(12) United States Patent
Appelbaum

(10) Patent No.: US 7,255,230 B1
(45) Date of Patent: Aug. 14, 2007

(54) CARD AND BLISTER PACKAGE

(76) Inventor: Paul Appelbaum, 16371 Wimbledon Ave., Huntington Beach, CA (US) 92649

( * ) Notice: Subject to any disclaimer, the term of this patent is extended or adjusted under 35 U.S.C. 154(b) by 0 days.

(21) Appl. No.: 11/453,682

(22) Filed: Jun. 16, 2006

(51) Int. Cl.
*B65D 75/26* (2006.01)

(52) U.S. Cl. ..... 206/463; 206/806; 206/467; 206/470

(58) Field of Classification Search ..... 206/461, 206/462, 463, 464, 465, 467, 470, 806
See application file for complete search history.

(56) References Cited

U.S. PATENT DOCUMENTS 2,618,383 A * 11/1952 Chapman et al. ..... 206/231
4,319,684 A * 3/1982 Backman et al. ..... 206/464
4,331,237 A * 5/1982 Edell ..... 206/461
4,499,353 A * 2/1985 Shields ..... 206/470
4,739,883 A * 4/1988 Mohs et al. ..... 206/470
4,981,212 A * 1/1991 Lutz et al. ..... 206/465
5,090,570 A * 2/1992 Todd ..... 206/463
5,360,110 A * 11/1994 Hirai et al. ..... 206/714
5,593,036 A * 1/1997 Dyble et al. ..... 206/464
5,699,913 A * 12/1997 Richardson ..... 206/470
5,899,334 A * 5/1999 Domerchie et al. ..... 206/470
6,076,675 A * 6/2000 Pawlowski ..... 206/459.5
2005/0082185 A1* 4/2005 Lee ..... 206/335

* cited by examiner

*Primary Examiner*—Mickey Yu
*Assistant Examiner*—Jerrold Johnson

(57) ABSTRACT

A card and blister package for small articles of commerce has a clear plastic blister piece, a card and a retainer piece. The blister walls form an article-receiving cavity and a plurality of upwardly projecting spaced-apart male prongs extending along the upper edge of the blister piece. A generally rectangular card has shaped perforations for receiving there-through the prongs of the blister piece and the retainer comprises a generally rectangular ring having a plurality of sockets for receiving the prongs of the blister piece, whereby the prongs can be engaged through the perforations, snapped into engagement with the ring sockets, and UV-activated adhesive on the engaged parts illuminated by UV light so as to bond to the ring to the blister to secure the package.

11 Claims, 3 Drawing Sheets

CARD AND BLISTER PACKAGE

BACKGROUND OF THE INVENTION

1. Field of the Invention

The present invention relates generally to apparatus and methods for packaging articles of commerce in card-and-blister packages.

2. Description of the Prior Art

Card and blister packages are widely used for packaging small articles of commerce. Typically such a package will have a clear plastic blister piece, i.e. an open topped enclosure having a flange that is bonded to the flat surface of a generally rectangular card commonly using ultrasonic or RF techniques. In spite of its popularity there remain some shortcomings with such packages. For example they are vulnerable to tampering since the card and blister interface can be defeated by pealing back the blister flange from the card or otherwise separating the two components.

SUMMARY OF THE INVENTION

In view of the foregoing and other limitations it is a general object of the present invention to provide an improved card-and-blister package.

A more particular object is to provide a card-and-blister package that is strong, attractive, and resistant to tampering.

Yet another object is to provide such a package that lends itself advantageously to fast and efficient UV sealing technology.

These and other objects and advantages are provided by the present invention that comprises a card-and-blister package that includes a blister piece, a card, and a blister retainer ring.

The blister piece has walls that form an article-receiving cavity and a plurality of upwardly projecting prongs are spaced apart along the upper edge portion of the blister piece walls. The card has shaped perforations or thru-cuts that are configured for receiving the prongs of the blister piece, and the retainer ring comprises a ring frame having a plurality of downwardly-opening socket elements spaced there-along for receiving the blister prongs, whereby the prongs are engagable through the card perforations and pressed into engagement with the retainer socket elements and adhesively bonded thereto to seal the package.

A variant of the invention includes a perforated card, and a retainer ring, and features an interchangeable "inner blister" or module, and a retainer for the module.

The module has an article-receiving blister portion and a flange that extends around the upper perimeter of that portion. The module retainer has a generally flat major surface with a central opening adapted to snugly receive the blister portion of the module to stabilize it against lateral movement, and the flange which will engage the major surface to hold the module against relative outward movement. The outer periphery of the module retainer is characterized by a plurality of upwardly projecting prongs. With the module engaged in the module retainer, the prongs can be placed through the card perforations and engaged by and bonded to the socket elements of the retainer ring to secure the package.

Yet another variant, like the first above-mentioned embodiment, has a blister piece equipped with prongs, and there is means on the upper edge portion of the blister for receiving and supporting the periphery of the card.

A retainer ring has a socket-equipped frame that is hingedly attached to the blister piece in the fashion of a clamshell package, and it can be rotated to bring its sockets into engagement with the blister prongs, and the frame is adapted to engage the card periphery to secure the card and complete the package.

DETAILED DESCRIPTION OF THE INVENTION

Figure 1:
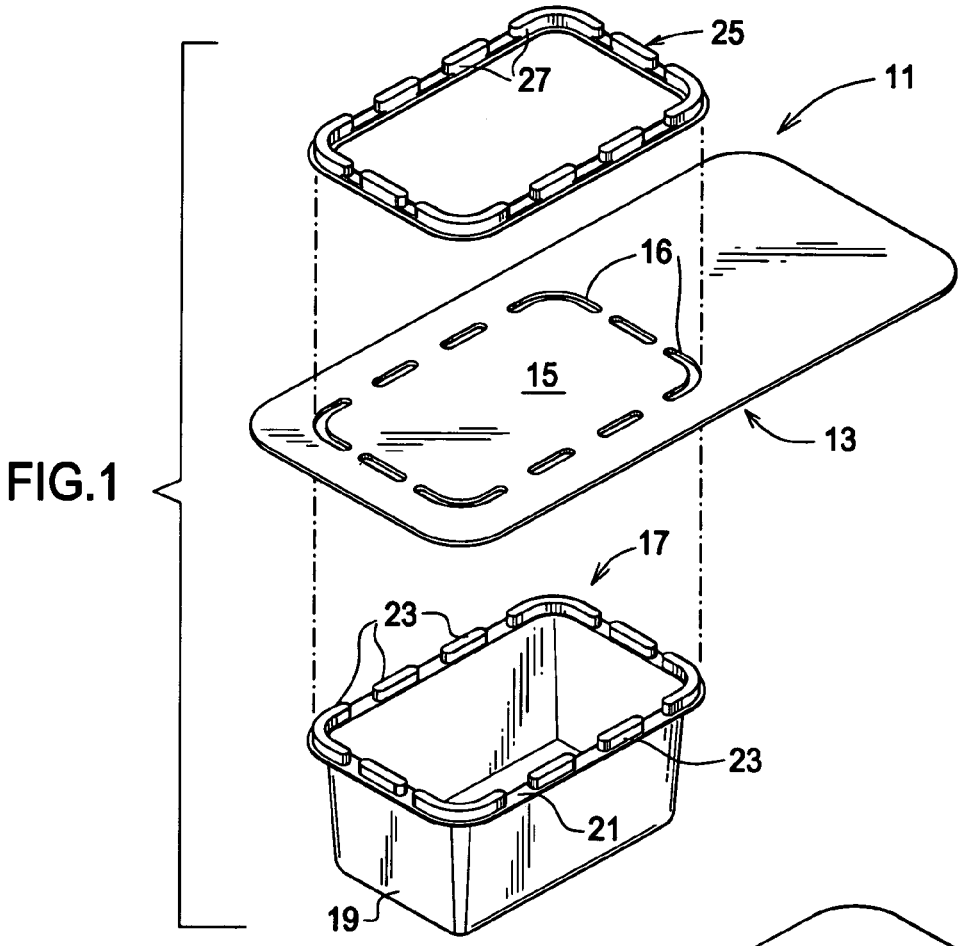
FIG. 1 is an exploded perspective view of a card-and blister package according to the present invention.
Figure 2:
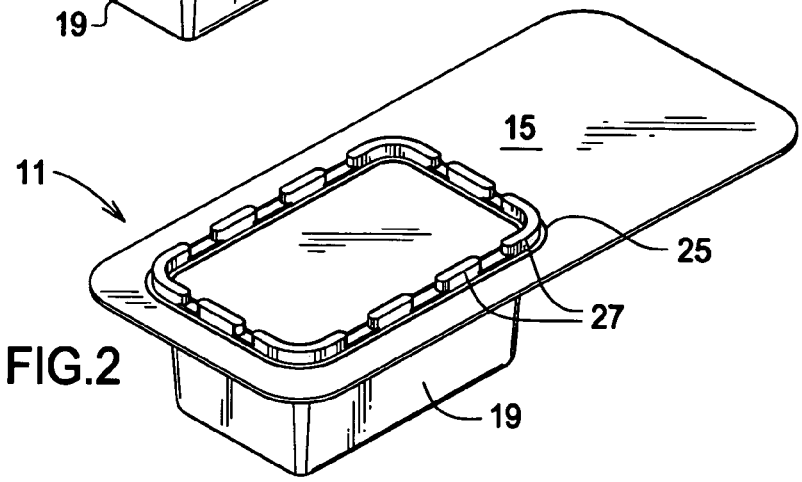
FIG. 2 is a perspective view of a sealed package according to the present invention.
Figure 3:
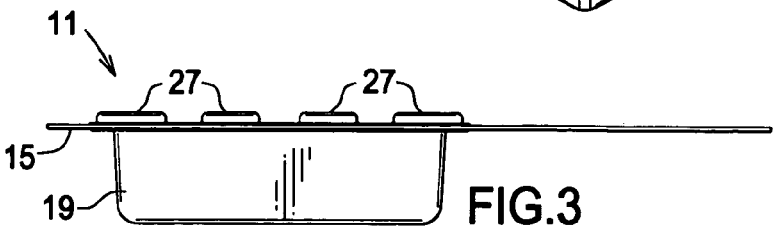
FIG. 3 is a side elevational view of the package of FIG. 2.

Referring now to the drawings, FIG. 1 shows that a preferred embodiment of a card-and-blister package 11 according to the present invention comprises three pieces: a card 13, a blister member 17 and a retaining ring 25 of which the blister member and ring are fabricated of a suitable, clear UV light transparent plastic using thermo-forming techniques known in the plastic molding industry. The blister member 17 includes an article-receiving portion 19 having a flange 21 that is characterized by a number of upwardly projecting, spaced apart male prongs or tongues 23 extending therealong.

The retainer ring 25 has a number of downwardly opening socket elements 27 that are arranged in corresponding relationship to the blister prongs 23 and are designed with conventional snap-lock features to receive and be snapped into engagement with the prongs.

The card portion 13 is comprised of a flat semi-rigid card-like sheet material such as a suitably strong compressed paper board, card board or plastic. Note that the perforations 16 are shaped and spaced so as to snugly receive the aforementioned blister prongs 23

After articles of commerce are placed in the blister 17, the blister prongs 23 can be fully engaged through perforations 16 of card 13, and then the socket elements 27 of ring 25 snapped into engagement with the prongs 23. When liquid UV adhesive has been applied to the "proud points" of the prongs 23, the adhesive is spread over mutually engaged surfaces and UV illumination will cause the adhesive to instantly cure to secure the prongs to the ring cavities and seal the package.

Figure 4:
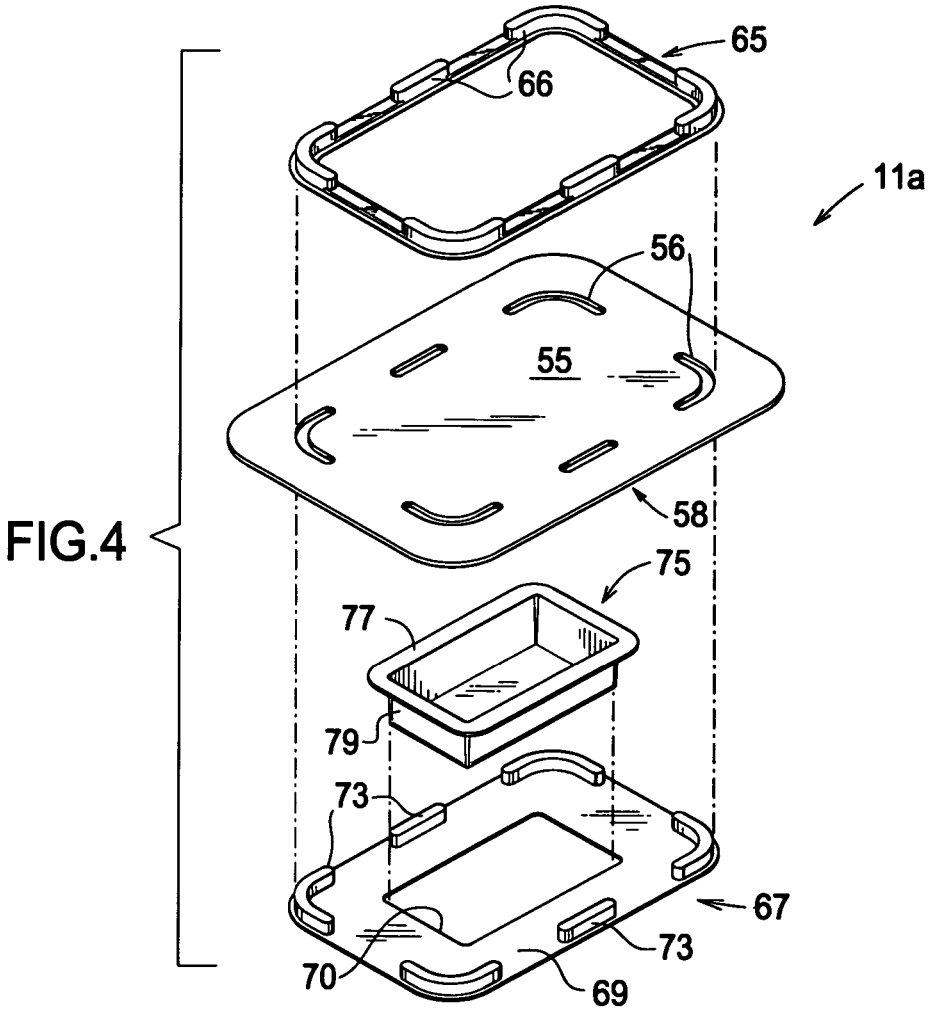
FIG. 4 is an exploded perspective view of a variant of the present invention.
Figure 5:
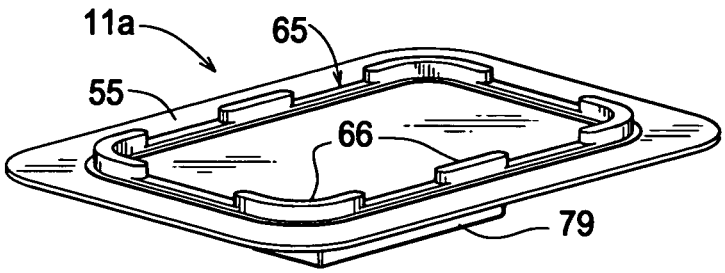
FIG. 5 is a top perspective view of the assembled package of FIG. 4.
Figure 6:
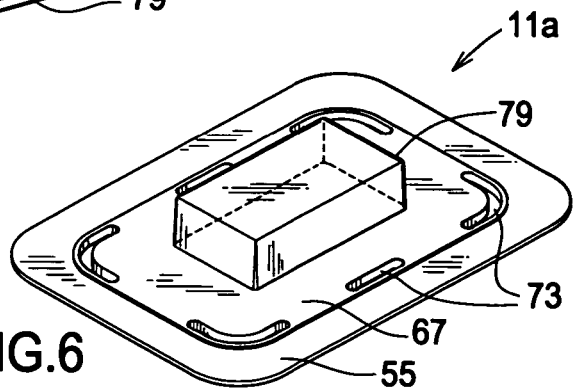
FIG. 6 is a bottom perspective view of the package shown in FIG. 5.

A variant of the invention shown in FIGS. 4-6 features an interchangeable "inner blister" or module that, among other things, can have various shapes to accommodate different products without requiring changes in tooling for the major package components.

Accordingly FIG. 4 shows package 11(*a*) which has a perforated card 53, a ring 65, a module 75, and a blister retainer 67. The module 75 has flange 77 and a blister section 79 that can be snugly received through the opening 70 in the retainer 67 to hold it against lateral movement, and the undersurface of the flange 77 will engage the flat surface 69 to hold it against outward movement. The prongs 73 of the blister retainer 67 can then be applied through the perforations of the card 53, so as to "sandwich" the flange 77 between the card and retainer 67. Finally, the socket elements 66 of ring 65 can be pressed into engagement with adhesive-coated prongs 73 and subsequent UV curing will seal and secure the package.

Figure 7:
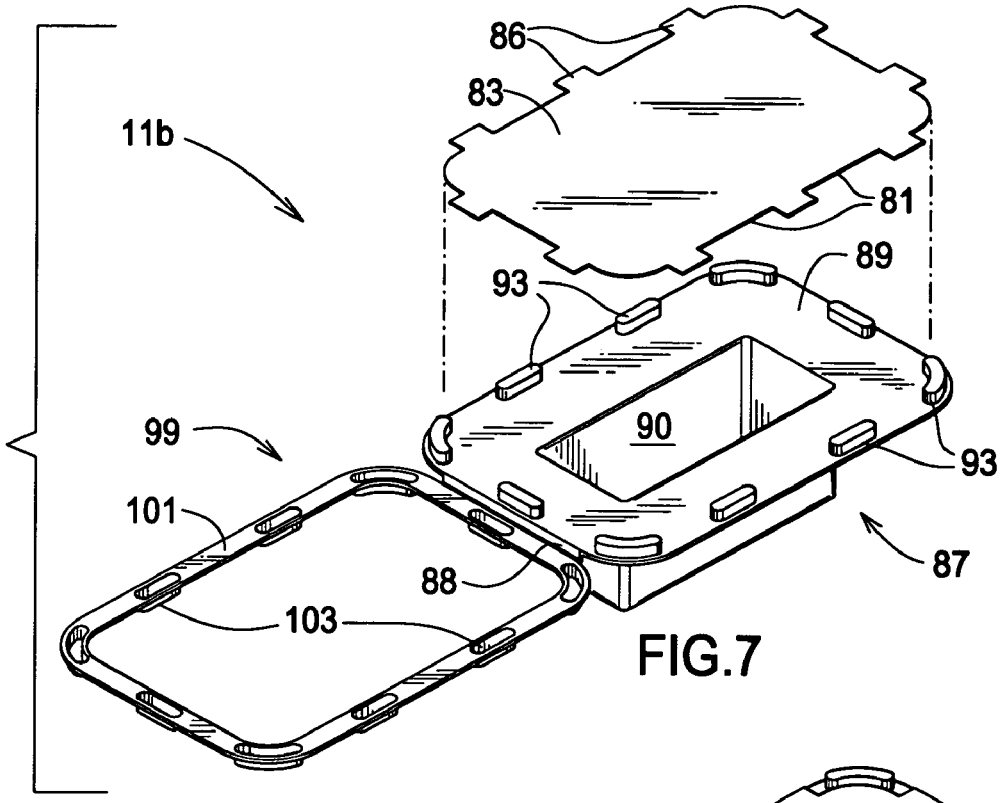
FIG. 7 is an exploded perspective view of yet another variant of the present invention.

Yet another advantageous variant of the invention is shown in FIG. 7, where the package 11(*b*) is shown to comprise blister piece 87 that is connected by "living" hinge 88 to a retainer ring 99, and a card 83 for covering the blister piece 87. Note the blister piece 87 has cavity 90 and flange 89 with an outer perimeter of spaced-apart prongs 93.

Figure 8:
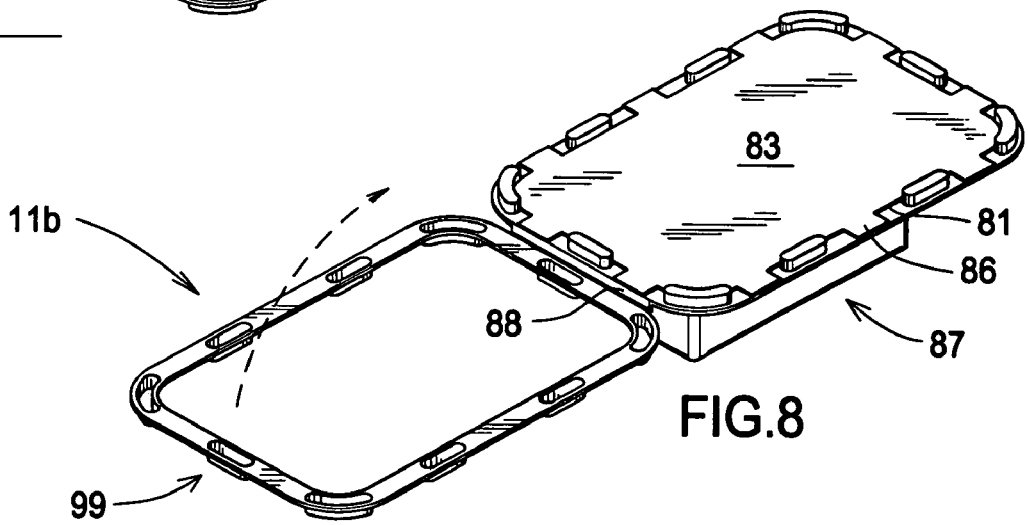
FIG. 8 is a perspective view showing a card installed in the open package of FIG. 7.
Figure 9:
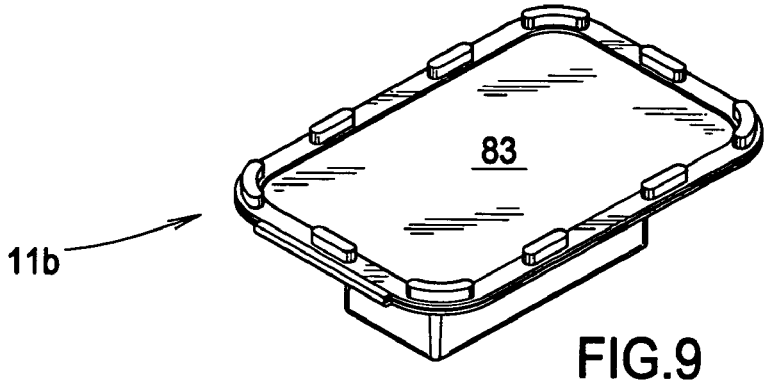
FIG. 9 is a top perspective view of the sealed package of FIG. 8.

Note the tabs 86 that extend from the perimeter 81 of card 83, and as FIG. 8 best shows, when the card is placed in covering position, its perimeter 81 will seat against the inside surfaces of the prongs 93 to stabilize the card, while the tabs 86 engage the flange surfaces that lie between adjacent prongs.

The hinged retaining ring 99 has frame member 101 that is equipped with socket elements 103 which are configured to engage the prongs 93 when ring 99 is rotated from the position shown in FIG. 8 to a closed position. Thus, after articles of commerce are placed in cavity 90, card 83 can be positioned thereover, and the ring 99 rotated to a closed position to bring the prongs 93 into full engagement with corresponding socket elements 103. The frame 101 will thereby engage tabs 86 to hold the card in place against vertical movement. Securing of the package is completed by subsequent UV bonding as with the other variants of the invention.

Various modifications and variations of the invention will be evident to persons of ordinary skill in the art, given the benefit of this disclosure; for example, packages of circular configurations and "clamshell-like" variants having inner blisters are contemplated under the invention. It is intended that the invention be given its full scope and breath as defined in the claims that follow.

What is claimed is:

1. A card-and-blister package for small articles of commerce, including:

a) a blister piece having walls that define a cavity for receiving said articles of commerce, and an upper edge perimeter portion and a plurality of upwardly projecting prongs spaced apart along said upper edge perimeter portion;

b) a card member adapted to engage said blister upper edge portion to cover said cavity, and c) a retainer ring having a plurality of downwardly opening socket elements spaced apart along said ring, and said sockets adapted to make engagement within said blister prongs, whereby with said card in its cavity-covering position said retainer ring sockets can be pressed into engagement with said blister prongs to secure said card.

2. A package as defined in claim 1 wherein said card has a plurality of shaped perforations that are configured and spaced for receiving there-through said blister prongs.

3. A package as defined in claim 2 wherein said perforations have edges that engage said prongs to hold said card against relative lateral movement.

4. A package as defined in claim 2 wherein said retainer ring is attached by a hinge to said blister upper edge portion and whereby said ring can be rotated to bring its socket elements into engagement with said corresponding prongs on said blister piece.

5. A package as defined in claim 4 including an inner blister module having an article-receiving portion with sidewalls and a bottom, and a flange extending around the upper edge of said module article-receiving portion, wherein said blister piece has a generally flat major surface with an opening for receiving said module article-receiving portion, to hold said module against relative lateral movement, and the flange engaging said major surface to hold said module against outward movement, and said flat major surface holding said flange against said card.

6. A package as defined in claim 1 wherein said prongs are adapted to make snap-lock engagement with said sockets elements.

7. A package as defined in claim 1 wherein the upper edge portion of said blister piece has ledge means for receiving and supporting the periphery of said card and holding it against relative lateral and downward movement.

8. A package as defined in claim 7 wherein said retainer ring is attached by a hinge to said blister upper edge portion and whereby said ring can be rotated to bring its socket elements into engagement with said corresponding prongs on said blister piece.

9. A package as defined in claim 1 wherein said blister piece and retainer ring have generally rectangular configurations.

10. A package as defined in claim 1 including an inner blister module having an article-receiving portion with sidewalls and a bottom, and a flange extending around the upper edge of said module article-receiving portion, wherein said blister piece has a generally flat major surface with an opening for receiving said module article-receiving portion, to hold said module against relative lateral movement, and the flange engaging said major surface to hold said module against outward movement, and said flat major surface holding said flange against said card.

11. A package as defined in claim 1 wherein said retainer ring is attached by a hinge to said blister upper edge portion and whereby said ring can be rotated to bring its socket elements into engagement with said corresponding prongs on said blister piece.

* * * * *